US008875727B2

(12) United States Patent
Wroblewski et al.

(10) Patent No.: US 8,875,727 B2
(45) Date of Patent: Nov. 4, 2014

(54) ROUGH-IN ADAPTER CLIP LOCK FOR A DRAIN ASSEMBLY

(71) Applicant: Zurn Industries, LLC, Erie, PA (US)

(72) Inventors: Douglas R. Wroblewski, Erie, PA (US); Christopher A. Majocka, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 108 days.

(21) Appl. No.: 13/750,271

(22) Filed: Jan. 25, 2013

(65) Prior Publication Data

US 2013/0206247 A1 Aug. 15, 2013

Related U.S. Application Data

(60) Provisional application No. 61/596,973, filed on Feb. 9, 2012.

(51) Int. Cl.
*E03F 5/04* (2006.01)

(52) U.S. Cl.
CPC ..... *E03F 5/0407* (2013.01); *E03F 2005/0413* (2013.01)
USPC ..... 137/15.09; 137/362; 4/286; 4/292

(58) Field of Classification Search
USPC ..... 137/15.01, 15.09, 362; 4/286, 287, 288, 4/292, 295
See application file for complete search history.

(56) References Cited

U.S. PATENT DOCUMENTS

| | | | | |
|---|---|---|---|---|
| 969,776 | A | | 9/1910 | Foley |
| 1,375,222 | A | | 4/1921 | Lutz |
| 1,434,254 | A | | 10/1922 | Sanders |
| 1,577,464 | A | | 3/1926 | High |
| 1,653,403 | A | | 12/1927 | McCue |
| 1,792,345 | A | * | 2/1931 | Williams ..... 137/362 |
| 1,830,065 | A | | 11/1931 | Luff |
| 2,519,843 | A | | 8/1950 | Matheis |
| 3,071,781 | A | | 1/1963 | Seewack |
| 3,107,687 | A | * | 10/1963 | Howe ..... 137/362 |
| 3,674,149 | A | | 7/1972 | Donalson |
| 3,700,381 | A | * | 10/1972 | Deeke ..... 4/288 |
| 4,257,892 | A | | 3/1981 | Boersma |
| 4,261,824 | A | | 4/1981 | Cuschera |
| 4,454,039 | A | | 6/1984 | McCoy |
| 4,475,844 | A | | 10/1984 | Arntyr et al. |
| 4,621,939 | A | | 11/1986 | Thomann et al. |
| 4,655,913 | A | | 4/1987 | Boersma |
| 4,871,451 | A | | 10/1989 | Piskula |
| 4,909,660 | A | | 3/1990 | Ferns |
| 4,910,811 | A | | 3/1990 | Izzi, Sr. |

(Continued)

*Primary Examiner* — Kevin Lee
(74) *Attorney, Agent, or Firm* — The Webb Law Firm

(57) ABSTRACT

A drain assembly includes a drain head, which includes a flange and a cylindrical stem, with the flange extending outwardly from the cylindrical stem. The assembly also includes an adapter. The adapter is configured to engage the cylindrical stem of the drain head to adjustably support the drain head on the adapter and has a support flange, the support flange having a top surface. The assembly further includes a clip having a top end and a bottom end. The top end of the clip is connected to an underside of the flange of the drain head and the bottom end is configured to engage the top surface of the support flange of the adapter to permit downward adjustment of the drain head with respect to the adapter and prohibit upward adjustment of the drain head with respect to the adapter.

12 Claims, 3 Drawing Sheets

(56) References Cited

U.S. PATENT DOCUMENTS

| | | | | |
|---|---|---|---|---|
| 4,952,094 | A | 8/1990 | Spiess et al. | |
| RE33,439 | E | 11/1990 | Thomann et al. | |
| 5,324,135 | A | 6/1994 | Smith | |
| 5,328,291 | A | 7/1994 | Wisniewski | |
| 5,437,516 | A | 8/1995 | Sauerwein et al. | |
| 5,527,131 | A | 6/1996 | Salmond et al. | |
| 5,564,860 | A | 10/1996 | Amann | |
| 5,592,701 | A * | 1/1997 | Smith | 4/292 |
| 5,692,248 | A * | 12/1997 | Ball | 4/286 |
| 5,733,444 | A | 3/1998 | Johnson | |
| 6,036,401 | A | 3/2000 | Morina et al. | |
| 6,058,525 | A | 5/2000 | Paden | |
| 6,092,244 | A | 7/2000 | Rizzardi et al. | |
| 6,165,357 | A | 12/2000 | Cormier | |
| 6,192,532 | B1 | 2/2001 | Sesser et al. | |
| 6,209,572 | B1 | 4/2001 | Wicklund | |
| 6,546,573 | B1 | 4/2003 | Ball | |
| 6,687,925 | B2 | 2/2004 | Minnick | |
| 6,755,966 | B1 | 6/2004 | Reed | |
| 6,802,962 | B1 | 10/2004 | Browne, III et al. | |
| 6,945,733 | B2 | 9/2005 | Rathmann et al. | |
| 7,066,685 | B2 | 6/2006 | Humphries et al. | |
| 7,191,794 | B2 | 3/2007 | Hodges | |
| 7,293,937 | B2 | 11/2007 | Fuchs et al. | |
| 7,370,663 | B2 | 5/2008 | Lundeberg et al. | |
| 7,503,083 | B2 | 3/2009 | Ball | |
| 7,533,499 | B2 | 5/2009 | Daigger et al. | |
| 7,735,512 | B1 | 6/2010 | Ismert et al. | |
| 7,878,110 | B1 | 2/2011 | Michnik et al. | |
| 7,964,095 | B1 | 6/2011 | Graybeal | |
| 8,230,535 | B2 | 7/2012 | Kik, Sr. et al. | |
| 2001/0003886 | A1 | 6/2001 | Mihalicz et al. | |
| 2005/0005970 | A1 | 1/2005 | Lundeberg et al. | |
| 2005/0055916 | A1 | 3/2005 | Daigger et al. | |
| 2006/0159515 | A1 | 7/2006 | Messerschimidt et al. | |
| 2006/0171778 | A1 | 8/2006 | Fuchs et al. | |
| 2006/0283792 | A1 | 12/2006 | McCallum | |
| 2007/0034577 | A1 | 2/2007 | Bayard et al. | |
| 2007/0044218 | A1 | 3/2007 | Ball | |
| 2007/0144954 | A1 | 6/2007 | Neuber | |
| 2007/0209109 | A1 | 9/2007 | Meyers | |
| 2007/0236002 | A1 | 10/2007 | Knight | |
| 2008/0277324 | A1 | 11/2008 | Meyers | |
| 2009/0172877 | A1 | 7/2009 | Ball | |
| 2009/0265850 | A1 | 10/2009 | Kuo | |
| 2010/0133159 | A1 | 6/2010 | Priester | |
| 2010/0288685 | A1 | 11/2010 | Meyers | |
| 2010/0319281 | A1 | 12/2010 | Egan | |
| 2011/0120924 | A1 | 5/2011 | Coscarella | |

* cited by examiner

ROUGH-IN ADAPTER CLIP LOCK FOR A DRAIN ASSEMBLY

CROSS REFERENCE TO RELATED APPLICATION

The present application claims priority from U.S. Provisional Patent Application No. 61/596,973, filed on Feb. 9, 2012, which is incorporated herein by reference in its entirety.

BACKGROUND OF THE INVENTION

1. Field of the Invention

The present invention relates to drains and other utility inlet or outlet type fixtures installed in concrete slabs or floors, and, more particularly, to a system for installing such fixtures using a coring adapter around which the slab is poured, the coring adapter including a mechanism for retaining the fixture to the coring adapter.

2. Description of Related Art

Drains or drain fixtures are installed in concrete slabs, such as concrete floors in warehouses, garages, basements, parking lots, commercial buildings, and residential buildings, to accept water or other liquids from the top surface of the floor and provide a means for such liquids to flow into an underlying drain pipe. The drain is typically funnel shaped, with a tapered upper portion or drain head and a lower stem adapted for connecting the drain to an adapter or extension member for a drain pipe projecting from the ground or substrate underlying the slab. The drain head includes a grate or strainer at an upper end thereof to prevent large pieces of debris from entering and clogging the drain pipe.

A typical prior art installation assembly includes a female threaded adapter or connector that is attached to a vertically extending drain pipe. A drain, drain assembly, or cleanout with a threaded lower section is threaded into the adapter. The height of the drain or drain assembly may be minimally adjusted up or down by threading the drain further into or out of the adapter.

Typically, drain adapters and associated drains are installed upon the drain pipe prior to pouring the surrounding concrete slab that typically provides the primary floor support surface. Ideally, the drain is installed at the proper height to allow for proper drainage and so that the grate will be flush with the finished floor surface. However, drain fixtures are subject to being damaged or infiltrated by concrete during pouring of the floor and subsequent construction of the building structure. Cleaning and repair of the fixture after completion of the project also requires considerable time.

Additional problems can arise when a layer of tile or other flooring material is installed over the concrete slab. In such instances, the drain is typically installed so that the top surfaces will extend above the level of the slab a distance equal to the thickness of the flooring. Unfortunately, it is not uncommon for the concrete slab to be mistakenly poured to the top of the drain instead of a specified lower level, thereby creating the need for further upward adjustment of the drain. Such adjustment is often not provided for by the drain adapter assembly.

Once the concrete is poured around the drain and has set, it is usually impossible to raise or lower the drain without chipping away the concrete surrounding the drain to provide clearance for lugs usually formed on the bottom of the drain head and to break the adhesion between the concrete and the drain head surface. Similarly, if the building owner later decides to add a layer of flooring over the slab or to substitute existing flooring with a thicker layer, it is usually impossible to raise the drains to the higher level without first chipping or breaking away the concrete from around the drain head.

One solution to the above-mentioned problems has been provided by U.S. Pat. No. 7,735,512 (hereinafter "the '512 patent"), issued on Jun. 15, 2010, which is hereby incorporated by reference in its entirety. The '512 patent discloses a floor drain installation system that includes an adapter attached to a drain pipe projecting from the ground, a coring sleeve having a bowl-shaped upper end attached to or integral with the adapter, and a coring plug received within the bowl of the coring sleeve to close off the drain pipe during pouring of a concrete floor and to create space for subsequent reception of a drain head and grate. One drawback to the system disclosed in the '512 patent is that in making the drain head easily adjustable with respect to the poured slab and the finished floor, the drain head has also been made easily removable by vandals or thieves searching for scrap metal in an incomplete or unoccupied installation.

SUMMARY OF THE INVENTION

There is a general need in the art, therefore, for a floor drain installation system that allows for roughing in of a poured concrete slab prior to installation of a drain head and grate and for adjustment of the grate relative to the poured slab, while preventing tampering with or theft of the drain head and grate.

According to one embodiment, the present invention provides for a lock-type feature incorporated into a drain head that is used to secure the drain head on an adapter and prevent the drain head from being removed once it is adjusted in place. A flexible yet rigid clip is added to the drain head and engages corresponding grooves or slots in the adapter. The clip allows a user to thread the drain head (clockwise) into the adapter, but to not allow the drain head to be unthreaded (counterclockwise) out of the adapter. The clip/groove combination is configured so that the clip can pass over then fall into and engage the groove as the drain head is threaded into the adapter. The clip will not prevent the drain head from turning in a clockwise direction. As the user tries to unscrew the drain head (counterclockwise), the clip will fall into and engage one of the grooves and prevent the drain head from further turning in the counterclockwise direction, thus locking the drain head from further counterclockwise turns in a manner similar to a ratcheting driver. If the user needs to unthread the drain head, the clip can be disengaged by removing a small screw (vandal-proof type) that attaches the clip to the underside of the drain head. Once disengaged, the drain head can be backed out of the adapter, the clip can then be reattached, and the drain head reattached to the adapter.

According to another embodiment, the present invention provides a drain assembly that includes a drain head, the drain head having a drain head flange and a cylindrical stem depending from the drain head flange; an adapter, the adapter having a support flange and a hollow cylindrical neck, the hollow cylindrical neck being configured to receive the cylindrical stem of the drain head to rotatably and adjustably connect the drain head to the adapter, the support flange having a top surface with a plurality of radial grooves defined therein; and a clip having a top end and a bottom end, the top end being connected to an underside of the drain head flange of the drain head, and the bottom head being configured to fall into and engage the grooves in the top surface of the support flange of the adapter. The clip is configured to engage the drain head and the grooves in the adapter to permit downward rotational adjustment of the drain head with respect to the support flange of the adapter and prohibit upward rotational adjustment of the drain head.

According to one particular embodiment of the present invention, a drain assembly is provided. The drain assembly includes a drain head, the drain head having a flange and a cylindrical stem, the flange extending outwardly from the cylindrical stem; an adapter, the adapter being configured to engage the cylindrical stem of the drain head to adjustably support the drain head on the adapter and having a support flange, the support flange having a top surface; and a clip having a top end and a bottom end, the top end being connected to an underside of the flange of the drain head, and the bottom end being configured to engage the top surface of the support flange of the adapter to permit downward adjustment of the drain head with respect to the adapter and prohibit upward adjustment of the drain head with respect to the adapter.

According to another particular embodiment of the present invention, a method of adjustably connecting a drain head of a drain assembly to an adapter is provided. The method includes the step of providing a drain assembly, the drain assembly including a drain head, the drain head having a flange and a cylindrical stem, the flange extending outwardly from the cylindrical stem; an adapter, the adapter having a support flange and being configured to engage the cylindrical stem of the drain head to adjustably support the drain head on the adapter, the support flange having a top surface; and a clip having a top end and a bottom end, the top end being connected to an underside of the flange of the drain head. The method further includes the steps of adjusting the drain head downward with respect to the adapter, and engaging the top surface of the support flange of the adapter with the bottom end of the clip to permit downward adjustment of the drain head with respect to the adapter and prohibit upward adjustment of the drain head with respect to the adapter.

Further details and advantages of the invention will become clear upon reading the following detailed description in conjunction with the accompanying drawing figures, wherein like parts are designated with like reference numerals throughout.

DESCRIPTION OF THE PREFERRED EMBODIMENTS

Figure 1:
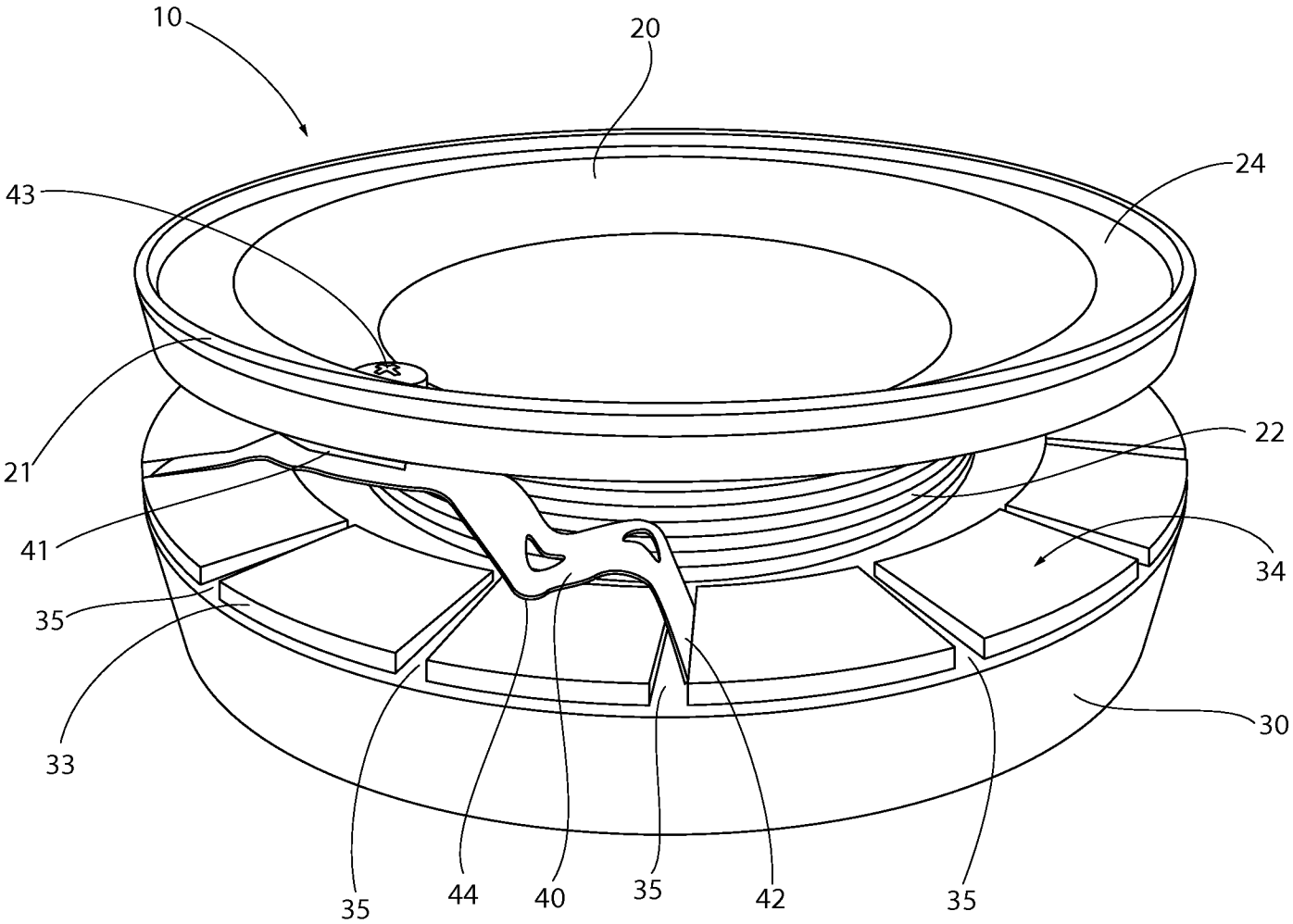
FIG. 1 depicts a perspective view of a drain assembly according to an embodiment of the present invention.
Figure 2:
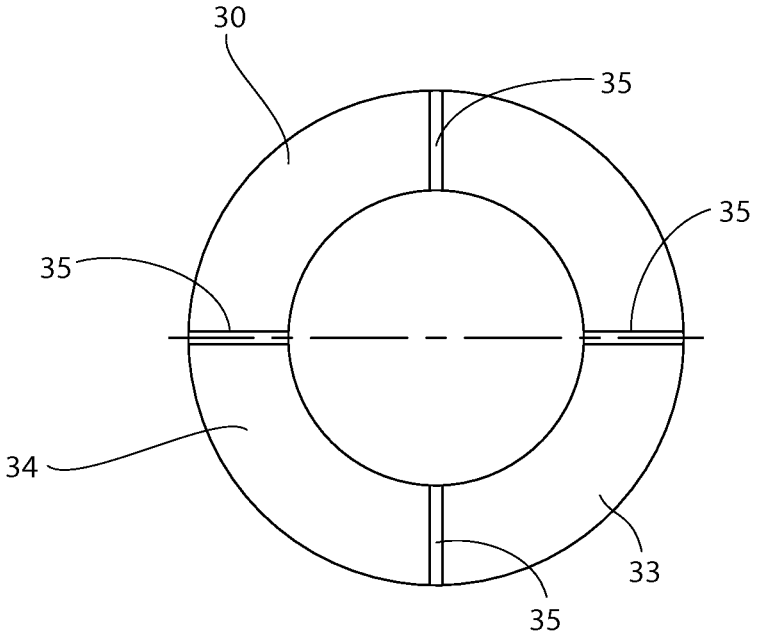
FIG. 2 depicts a top view of an adapter of the drain assembly of FIG. 1.
Figure 3A:
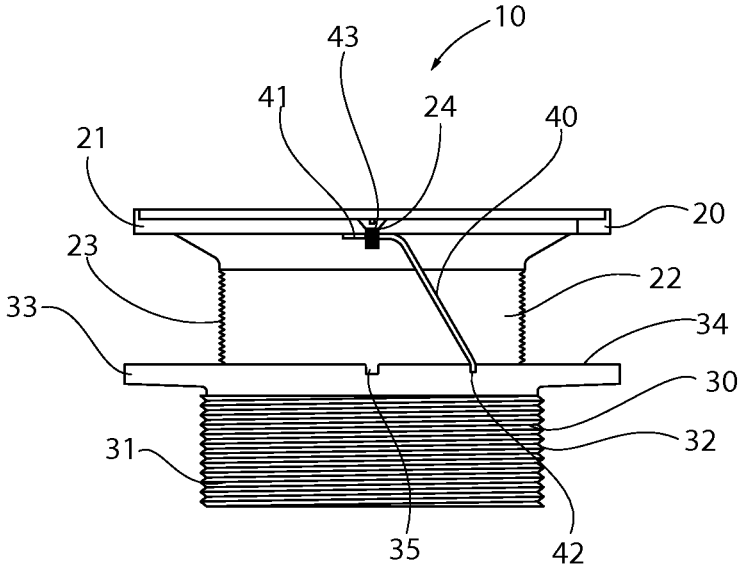
FIGS. 3A-3D depict a series of side views of the drain assembly of FIG. 1 illustrating the operation of the drain assembly according to an embodiment of the present invention.
Figure 3B:
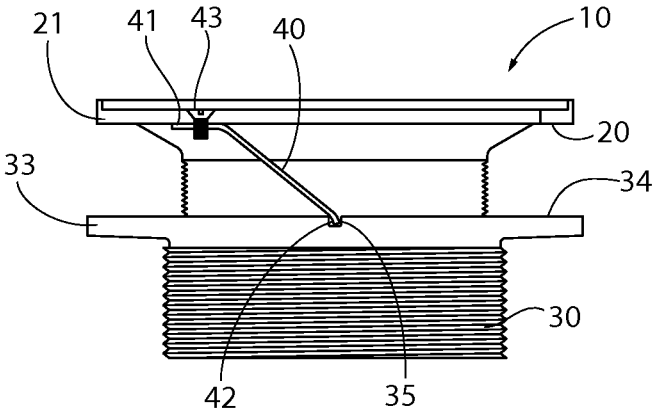
Figure 3C:
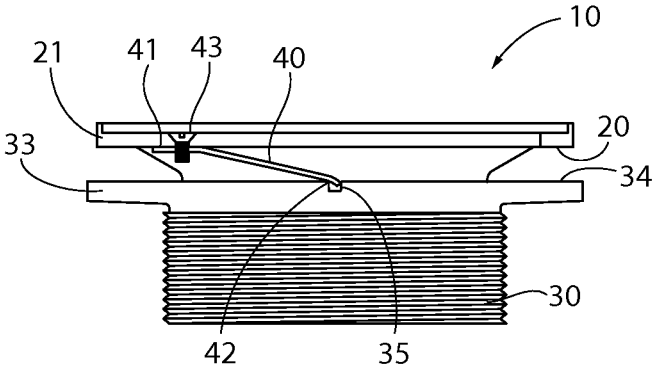
Figure 3D:
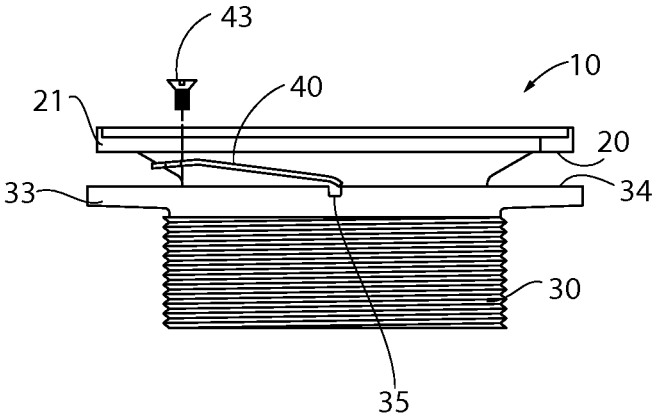

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

With reference to FIGS. 1-3D, a drain assembly 10 is shown in accordance with an embodiment of the present invention. According to one embodiment, the drain assembly 10 may be of the "rough-in" type, meaning that the drain assembly 10 is configured so that it may be at least partially installed prior to finishing of the surrounding floor. The drain assembly 10 includes a coring adapter (not shown) that creates a void in the finished floor surface that allows for installation of a drain head fixture at a height level with the surrounding finished floor surface. An example of such a "rough-in" drain assembly is provided by the above-mentioned '512 patent.

As shown in FIGS. 1-3D, the drain assembly 10 includes a drain head 20 having a central opening for receiving water or other liquids and allowing those liquids to pass into a drain pipe in fluid communication with the drain head 20. The drain head 20 includes a flange 21, which defines a bowl or funnel-shaped recess for directing the liquids toward the central opening, and a hollow cylindrical stem 22 depending from the flange 21. The flange 21 extends outwardly from the top of the cylindrical stem 22. The stem 22 includes external threading 23 thereon. Though not illustrated, it is to be appreciated that the recess of the flange 21 of the drain head 20 may be covered by a grate or similar device fastened to the flange 21.

The assembly 10 also includes an adapter 30. The adapter 30 is correspondingly shaped to the drain head 20 and includes a hollow cylindrical neck 31 and a support flange 33 placed on an end of the neck 31. The neck 31 receives the hollow cylindrical stem 22 of the drain head 20 to rotatably and adjustably support the drain head 20 on the adapter 30. The neck 31 includes internal threading (not shown) for threadably engaging the external threading 23 on the cylindrical stem 22 of the drain head 20 to rotatably and adjustably connect the drain head 20 to the adapter 30. The neck 31 also includes external threading 32 for connecting the adapter 30 to the exposed end of a drain pipe. The support flange 33 extends outwardly from the neck 31 and defines a top surface 34. The top surface 34 includes a plurality of radially extending grooves 35 defined therein. It is to be appreciated that the support flange 33 may be the base surface of an upwardly extending bowl.

A clip 40, which has a top end 41 and a bottom end 42, extends between the underside of the flange 21 of the drain head 20 and the top surface 34 of the support flange 33 of the adapter 30. The clip 40 is made of a flexible material that is bendable, when a bending moment is applied to the ends 41, 42 of the clip 40 due to the downward adjustment of the drain head 20 on the adapter 30, but is also rigid in compression. One such material can be spring steel. The top end 41 of the clip 40 is connected to the underside of the flange 21 of the drain head 20 by a fastener 43, which extends through a hole 24 defined in the flange 21. The fastener 43 may be a screw and preferably includes tamper-proof features known to those having ordinary skill in the art so that the fastener 43 can only be removed by authorized personnel. The bottom end 42 of the clip 40 is configured to fall into and engage the radially extending grooves 35 in the top surface 34 of the support flange 33 of the adapter 30. As shown in FIG. 1, the clip 40 may include at least one intermediate bend 44 formed therein to promote flexure and bending of the clip 40.

As shown in FIGS. 3A-3D, as the drain head 20 is threaded into the internal threads in the neck 31 of the adapter 30, the top end 41 of the clip 40 engages the underside of the flange 21 of the drain head 20 and the bottom end 42 of the clip 40 engages each groove 35 in the top surface 34 of the support flange 33 and prevents the drain head 20 from being unthreaded from the adapter 30. This is so because the clip 40 is shaped such that, as the drain head 20 is rotated clockwise while being screwed into the adapter 30, the clip 40 will flex as the bottom end 42 falls into and exits the grooves 35 in the top surface 34 of the support flange 33, but, if the drain head 20 is rotated counterclockwise, the bottom end 42 of the clip 40 will engage within the grooves 35 to place the clip 40 in compression between the flange 21 of the drain head 20 and the side of the grooves 35, thereby locking the drain head 20 against further counterclockwise rotation. The clip 40 will become further deformed as the drain head 20 is threaded down into the adapter 30, but the bottom end 42 of the clip 40 will continue to engage the grooves 35 and prevent the drain head 20 from being unscrewed from the adapter 30. In this manner, the clip 40 permits downward rotational adjustment of the drain head 20 with respect to the adapter 30 and prohibits upward rotational adjustment of the drain head 20 with respect to the adapter 30. If the drain head 20 is accidentally threaded down too low, the clip 40 can be disassembled from the drain head 20 by unscrewing the fastener 43, thus releasing the "ratcheting" feature and allowing the drain head 20 to be unthreaded. The clip 40 can be reattached to the drain head 20 and the drain head 20 replaced on the adapter 30 to the correct height.

With reference to FIGS. 1-3D, according to one embodiment of the present invention, a method of adjustably connecting the drain head 20 of the drain assembly 10 to the adapter 30 includes the steps of providing the drain assembly 10 described above with reference to FIGS. 1-3D; adjusting the drain head 20 downward with respect to the adapter 30; and engaging the top surface 34 of the flange 33 of the adapter 30 with the bottom end 42 of the clip 40 to permit downward adjustment of the drain head 20 with respect to the adapter 30 and prohibit upward adjustment of the drain head 20 with respect to the adapter 30. The step of adjusting the drain head 20 may include rotatably and adjustably connecting the drain head 20 to the adapter 30 via an engagement between the cylindrical stem 22 of the drain head 20 and the hollow cylindrical neck 31 of the adapter 30. The engaging step may include engaging the radially extending grooves 35 in the top surface 34 of the support flange 33 of the adapter 30 with the bottom end 42 of the clip 40 to permit downward rotational adjustment of the drain head 20 with respect to the adapter 30 and prohibit upward rotational adjustment of the drain head 20 with respect to the adapter 30. The method may further include the step of disconnecting the top end 41 of the clip 40 from the flange 21 of the drain head 20 to allow for upward adjustment of the drain head 20 with respect to the adapter 30.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only, and not limiting as to the scope of the invention, which is to be given the full breadth of the appended claims and any and all equivalents thereof.

The invention claimed is:

1. A drain assembly, comprising:

a drain head, the drain head having a flange and a cylindrical stem, the flange extending outwardly from the cylindrical stem;

an adapter, the adapter being configured to engage the cylindrical stem of the drain head to adjustably support the drain head on the adapter and having a support flange, the support flange having a top surface; and a clip having a top end and a bottom end, the top end being connected to an underside of the flange of the drain head and the bottom end being configured to engage the top surface of the support flange of the adapter to permit downward adjustment of the drain head with respect to the adapter and prohibit upward adjustment of the drain head with respect to the adapter.

2. The drain assembly according to claim 1, wherein the cylindrical stem depends from the flange of the drain head.

3. The drain assembly according to claim 1, wherein the adapter further includes a hollow cylindrical neck, the hollow cylindrical neck being configured to receive the cylindrical stem of the drain head to rotatably and adjustably connect the drain head to the adapter.

4. The drain assembly according to claim 1, wherein the top surface of the support flange of the adapter has a plurality of radial grooves defined therein, the bottom end of the clip is configured to fall into and engage the radial grooves in the top surface of the support flange of the adapter, and the clip is configured to engage the flange of the drain head and the grooves in the top surface of the support flange of the adapter to permit downward rotational adjustment of the drain head with respect to the adapter and prohibit upward rotational adjustment of the drain head with respect to the adapter.

5. The drain assembly according to claim 1, wherein the clip is made from a material that is capable of bending and is rigid in compression.

6. The drain assembly according to claim 1, wherein the clip includes at least one intermediate bend therein.

7. The drain assembly according to claim 1, wherein the top end of the clip is connected to the flange of the drain head by a screw extending through the flange of the drain head.

8. A method of adjustably connecting a drain head of a drain assembly to an adapter, comprising the steps of:

providing a drain assembly, the drain assembly comprising:

a drain head, the drain head having a flange and a cylindrical stem, the flange extending outwardly from the cylindrical stem;

an adapter, the adapter having a support flange and being configured to engage the cylindrical stem of the drain head to adjustably support the drain head on the adapter, the support flange having a top surface; and a clip having a top end and a bottom end, the top end being connected to an underside of the flange of the drain head;

adjusting the drain head downward with respect to the adapter; and engaging the top surface of the support flange of the adapter with the bottom end of the clip to permit downward adjustment of the drain head with respect to the adapter and prohibit upward adjustment of the drain head with respect to the adapter.

9. The method according to claim 8, wherein the cylindrical stem depends from the flange of the drain head and the adapter further includes a hollow cylindrical neck, the hollow cylindrical neck being configured to receive and rotatably and adjustably support the cylindrical stem of the drain head, and wherein the step of adjusting the drain head includes rotatably and adjustably connecting the drain head to the adapter via an engagement between the cylindrical stem of the drain head and the hollow cylindrical neck of the adapter.

10. The method according to claim 9, wherein the top surface of the support flange of the adapter has a plurality of radial grooves defined therein, and wherein the engaging step includes engaging the radial grooves in the top surface of the support flange of the adapter with the bottom end of the clip to permit downward rotational adjustment of the drain head with respect to the adapter and prohibit upward rotational adjustment of the drain head with respect to the adapter.

11. The method according to claim 8, wherein the clip is made from a material that is capable of bending and is rigid in compression.

12. The method according to claim 8, further comprising the step of disconnecting the top end of the clip from the flange of the drain head to allow for upward adjustment of the drain head with respect to the adapter.

* * * * *